United States Patent [19]

Viegener

[11] Patent Number: 4,577,353

[45] Date of Patent: Mar. 25, 1986

[54] AIR-REGULATION DEVICE FOR THE INLET NOZZLES OF A WHIRLPOOL BATH

[75] Inventor: Walter Viegener, Attendorn, Fed. Rep. of Germany

[73] Assignee: Firma Franz Viegener II, Attendorn, Fed. Rep. of Germany

[21] Appl. No.: 589,190

[22] Filed: Mar. 13, 1984

[30] Foreign Application Priority Data

Mar. 18, 1983 [DE] Fed. Rep. of Germany ..... 3309760

[51] Int. Cl.[4] ..... A61H 33/02

[52] U.S. Cl. ..... 4/544; 239/61; 128/66

[58] Field of Search ..... 4/492, 541–544; 239/61; 128/66

[56] References Cited

U.S. PATENT DOCUMENTS 3,977,027 8/1976 Speck ..... 128/66 X
3,986,217 10/1976 Doerr et al. ..... 4/452
4,169,293 10/1979 Weaver ..... 4/544
4,419,775 12/1983 Ebert ..... 4/542

FOREIGN PATENT DOCUMENTS 2832804 2/1980 Fed. Rep. of Germany ..... 4/542

*Primary Examiner*—Charles E. Phillips
*Attorney, Agent, or Firm*—Sprung, Horn, Kramer & Woods

[57] ABSTRACT

An air-regulation device is combined into a single subassembly along with a pneumatic switch that activates a circulating pump associated with a bathtub. The common housing has air channels that open into connector bushings on a connector. The inlets to the air channels can be closed or opened by means of a control knob with a kidney-shaped air passage. The piston of the pneumatic switch is mounted in such a way as to slide within a chamber in the center of the housing. The piston is activated by means of a disk positioned in a recess in the knob. Air flows around the disk in all operating positions.

7 Claims, 4 Drawing Figures

AIR-REGULATION DEVICE FOR THE INLET NOZZLES OF A WHIRLPOOL BATH

BACKGROUND OF THE INVENTION

The present invention relates to an air-regulation device for the injector-equipped inlet nozzles of a whirlpool bath, having a control knob that is, first, mounted in such a way as to rotate on a housing that can be secured to a bathtub and, second, equipped with an air passage, whereby a circulating pump that draws water from the tub and supplies it to the injectors and that can be operated by means of a pneumatic switch with a manually activated piston is associated with the tub.

The circulating pump on a whirlpool bath is turned on and off for safety's sake by means of pneumatic switch. When a piston that is mounted in such a way as to slide within a cylinder chamber is activated, it compresses the air in the cylinder chamber of the pneumatic switch. The resulting pulse of air is forwarded by a hose and activates the switch on the circulating pump.

An air-regulation device is necessary at each side of the tub to regulate the volume of air in the inlet nozzles which are positioned on the sides and through which a mixture of water and air is introduced into the tub, in order to supply the requisite air to the inlet nozzles so that the intensity of their jets can be controlled independently.

The volume of air in known air-regulation devices is controlled by turning a control cap back and forth and is supplied to the mixing housing in the inlet nozzle. The air supplied to the mixing housing is suctioned up in accordance with the injector principle by the jet of water leaving the injector, resulting in a jet that varies in intensity in accordance with the setting of the control cap.

This design for the activating and regulating devices demands several perforations in the vicinity of the upper upper rim of the tub, and the large number of separate parts involved makes it expensive.

Since the device described in the foregoing cannot always be installed on the rim of a tub, it must if necessary be mounted in the nearby masonry. The necessity of laying the flexible connecting lines to some extent deep in the masonry entails the risk of their getting pinched.

SUMMARY OF THE INVENTION

The object of the present invention is to position and design the air-regulation device and the pneumatic switch for the circulating pump so that they can be combined into one subassembly that can be mounted in a perforation through the rim of the tub.

This object is attained in accordance with the invention in an air-regulation device of the aforesaid type wherein the piston for the pneumatic switch is mounted in such a way as to slide within a cylinder chamber in the housing of the air-regulation device and can be activated by a disk that has air flowing around it and that covers, while leaving a gap, the air passage in the control knob in all operating positions. Since the air-regulation device and the pneumatic switch that activates the circulating pump have a common housing, the subassembly is simple to install.

In one practical embodiment of the subassembly the housing can have a connection that extends along its longitudinal axis and another connection that extends at a right angle to the first, each connection having a channel that communicates with the region of compression inside the pneumatic switch.

The connections can have outside threading that a cap or connection nozzle can be screwed onto. A plumber can decide which connection, the hose that forwards the pulse of air generated in the pneumatic switch to the switch on the circulating pump, should be attached to on the basis of the on-site conditions.

In another embodiment of the invention the control knob can have a cylindrical outward-opening recess that the disk is positioned in, whereby the edge of the disk and an annular surface in the recess demarcate an annular air gap.

In a further embodiment the control knob can have a kidney-shaped air passage and the housing can be equipped with two air channels with a kidney-shaped cross-section that open into connector bushings.

In still another embodiment, the connector bushings can be parts of a connector that is made out of plastic and cemented to the housing.

Moreover, the connector can be slipped over the rear of the housing and positively secured.

Some preferred embodiments of the invention will now be described with reference to the attached drawings, wherein:

DETAILED DESCRIPTION OF THE PREFERRED EMBODIMENTS

Figure 1:
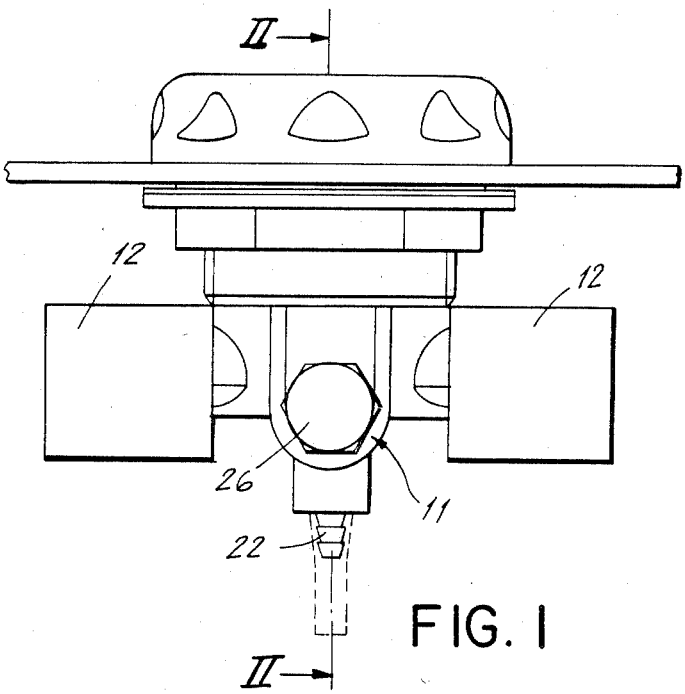
FIG. 1 is a horizontal projection of a subassembly consisting of an air-regulation device and a pneumatic switch for a circulating pump.
Figure 2:
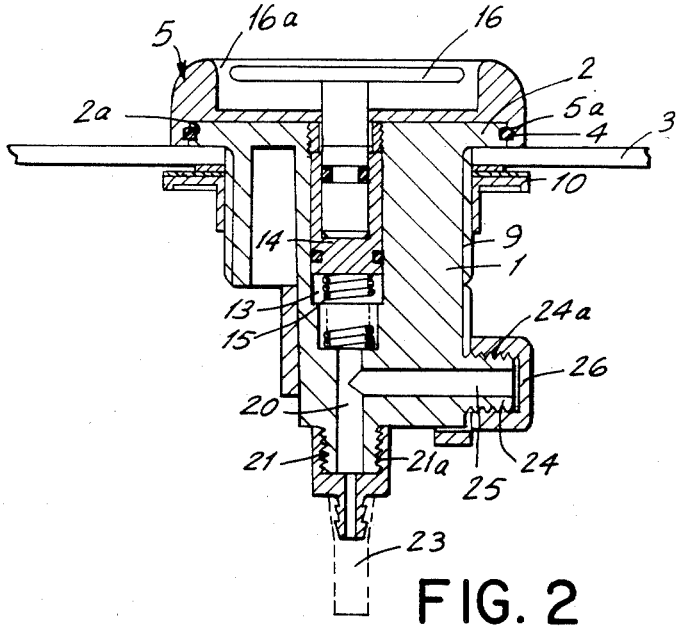
FIG. 2 is a section along line II—II in FIG. 1.
Figure 3:
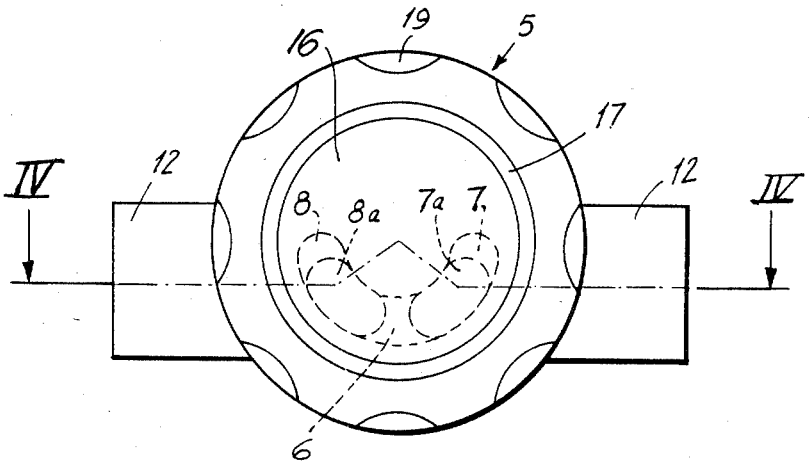
FIG. 3 is a front elevation of the subassembly.
Figure 4:
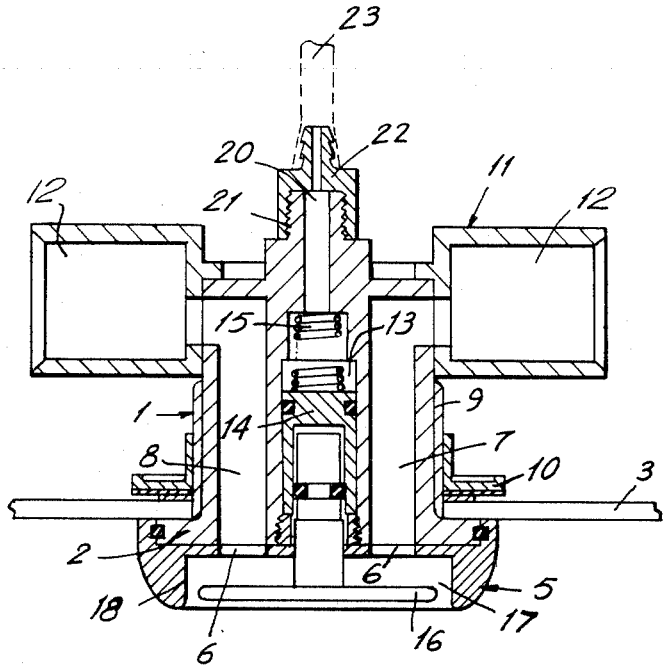
FIG. 4 is a section along the line IV—IV in FIG. 3.

Referring now to FIGS. 1–4, a subassembly consisting of an air-regulation device and a pneumatic switch for a circulating pump has a housing 1 with a mounting flange 2 that rests against the edge of a perforation in a bathtub 3. Mounting flange 2 is annular and is surrounded by an outward-opening groove 2*a* that an elastic ring 4 is positioned in. Elastic ring 4 engages an annular groove 5*a* in a control knob 5 that is secured by the ring, to mounting flange 2 while still being able to rotate. Control knob 5 has a kidney-shaped air passage 6 that can be positioned in the vicinity of one or two inlets 7*a*, 8*a*, also kidney-shaped, in air channels 7 and 8 in housing 1. The part of housing 1 adjacent to mounting flange 2 has outside threading 9, onto which a nut 10 is screwed to secure the housing to the edges of the perforation through tub 3. A connector 11 that matches the contour of the housing is slipped over the rear of housing 1 and positively secured to it in the embodiment illustrated. Connector 11 is also cemented to the rear of the housing.

Connector 11 has connector bushings 12 that the ends of the air lines leading to the mixing housing of the inlet nozzles are secured in. As will be evident from FIG. 4, air channels 7 and 8 empty into connector bushings 12.

In the center of housing 1 is a cylinder chamber 13 within which a piston 14 is mounted in such a way as to slide against the force of a spring 15. Piston 14 is activated by a disk 16 mounted in a cylindrical outward-opening recess 17 in control knob 5. Since there is an annular air gap 16*a* between the edge of disk 16 and the annular surface 18 of recess 17, air will flow around disk 16 in all operating positions. As long as the air passage in control knob 5 is in the vicinity of the inlets *7a, 8a,* to air channels 7 and 8, air can flow into the channels no matter what operating position disk 16 is in.

Control knob 5 has depressions 19 to make it easier to grip while it is being operated.

A channel 20 extends from cylinder chamber 13 to the outer end of a connection 21 that has outside threading 21*a* over which is screwed a nozzle 22 that communicates with a line 23 leading to the switch that activates the circulating pump. As will be evident from FIG. 2, housing 1 also has another connection 24 that extends at a right angle to connection 21 and has a channel 25 opening into channel 20. Connection 24, which also has outside threading 24*a,* is closed off in the embodiment illustrated in FIG. 2 by means of a cap 26. Cap 26 and connection nozzle 22 can be interchanged depending on which connection 21 or 24 the line 23 leading to the switch that activates the circulating pump is to be connected to.

It will be appreciated that the instant specification and claims are set forth by way of illustration and not limitation, and that various modifications and changes may be made without departing from the spirit and scope of the present invention.

What is claimed is:

1. A device for controlling a whirlpool bath assembly having an injector nozzle and a pneumatically actuated circulation pump, the device comprising: a housing connectable to a whirlpool tub and having a first air passage therein with an inlet and an outlet connectable to the nozzle; an air control knob having an aperture therein and mounted in the housing for rotation relative to the inlet for controlling the flow of air into the first air passage; means forming a second air outlet in the housing for connecting to the circulating pump; and pneumatic switch means mounted in the housing for applying air via the second air outlet to actuate the pump, the switch means comprising means forming a cylinder chamber in the housing in communication with the second air outlet, a piston slidably mounted in the cylinder, a disk connected to the piston and mounted over the control knob for movement toward and away from the housing to move the piston and thereby force air through the second air outlet and wherein the disk is configured to cover the aperture in the knob and to form an air gap to permit the passage of air to the aperture.

2. The device as in claim 1, wherein the means forming the second air outlet comprises a first connection on the housing extending along the longitudinal axis thereof and a second connection extending at a right angle to the first connection.

3. The device as in claim 2, wherein the connections have outside threading with a cap and a connection nozzle screwed thereon.

4. The device as in claim 1, wherein the control knob has a cylindrical outward-opening recess and the disk is positioned in the recess with the edge of the disk forming an annular gap with the wall of the recess.

5. The device as in claim 1, wherein the control know aperture is a kidney-shaped air passage and the housing has two first air passages with a kidney-shaped cross-section and having outlets that open into connector bushings.

6. The device as in claim 5, wherein the connector bushings comprise a connector composed of plastic and cemented to the housing.

7. The device as in claim 6, the connector is configured to be slipped over the rear of the housing and positively secured.

* * * * *